United States Patent [19]

Fleming

[11] Patent Number: 4,508,323

[45] Date of Patent: Apr. 2, 1985

[54] RUNNER FOR MOLTEN METAL

[75] Inventor: Georges Fleming, Esch, Luxembourg

[73] Assignee: ARBED S.A., Luxembourg, Luxembourg

[21] Appl. No.: 478,064

[22] Filed: Mar. 23, 1983

[30] Foreign Application Priority Data

Mar. 26, 1982 [LU] Luxembourg ..... 84042

[51] Int. Cl.[3] ..... C21B 7/14

[52] U.S. Cl. ..... 266/191; 266/196; 266/236

[58] Field of Search ..... 266/191, 195, 196, 46, 266/231, 236

[56] References Cited

FOREIGN PATENT DOCUMENTS

| | | | |
|---|---|---|---|
| 672321 | 2/1967 | Japan | 266/280 |
| 257261 | 7/1927 | United Kingdom . | |
| 392093 | 12/1973 | U.S.S.R. | 266/191 |

OTHER PUBLICATIONS

*European Application*, 0,060,239 1-3-82.

*Primary Examiner*—M. J. Andrews

*Attorney, Agent, or Firm*—Karl F. Ross; Herbert Dubno

[57] ABSTRACT

A metallurgical molten-metal runner has a support trough, a trough-shaped temperature-equalizing layer received in and lining the trough, a system for cooling the layer isothermally to about 100° C., a permanent refractory outer lining received in and lining the layer, and a renewable refractory inner lining received in and lining the outer lining and in direct contact with molten metal in the runner. The layer is of greater thermal conductivity than the linings. The cooling system includes conduits in heat-conducting engagement with the layer and an arrangement for circulating a coolant through the conduits. Water or, for safety's sake, oil can be used as the coolant, normally in liquid state to keep the layer below 100° C. The layer according to this invention has a coefficient of thermal conductivity greater than 10 Kcal/M·°C.·h, preferably above 25 Kcal/m·°C.·h and can be composed principally of silicon carbide, semigraphite, or graphite.

7 Claims, 2 Drawing Figures

RUNNER FOR MOLTEN METAL

FIELD OF THE INVENTION

The present invention relates to a pouring runner for molten metal. More particularly this invention concerns such a runner for iron issuing from a blast furnace.

BACKGROUND OF THE INVENTION

Molten iron is periodically tapped from the base of a blast furnace and flows along a trough or runner to a mold, ladle, or the like and the slag floating atop the metal is separated out by appropriately positioned baffles. Obviously the very hot—1300° C. to 1500° C.—molten metal and the slag are highly corrosive and hence erode the runner considerably.

At one time the furnace was tapped infrequently enough that the runner could be serviced between tappings, although the hot environment of the base of the blast furnace did not make such servicing convenient. Nowadays it is common to leave the runner at least partially full of molten iron between taps which may be 5h to 8h apart. Thus for servicing of this wear-prone runner it is necessary to shut down the furnace, a costly thing to do.

Accordingly the interior of the runner is lined with refractory material of a type similar to that used in metallurgical crucibles. This lining is fitted directly into the normally reinforced-concrete foundation of the blast furnace. Between tappings the temperature of the metal and slag in the runner still remains above 1300° C. Thus considerable heat is transmitted through the tile lining to the foundation, creating substantial thermal stresses. Cracking and breakouts around the runner are common.

It has therefore been suggested to mount the refractory lining in a metal trough supported above the floor adjacent the blast furnace. Forced or natural air flow over the trough cools it to 150° C. to 300° C. Such cooling does not permit particular areas of the runner to be cooled more or less, depending on operation. In addition this system is subjected to considerable differential thermal expansion and contraction as regards the cool metallic trough and its hot refractory lining, so that cracking of same is common, in particular when the runner is completely emptied. Once the lining is cracked the hot iron can contact the sheet-metal trough and damage it.

OBJECTS OF THE INVENTION

It is therefore an object of the present invention to provide an improved runner for molten metal.

Another object is the provision of such a runner for molten metal which overcomes the above-given disadvantages.

A further object is to provide a runner which can be set into the reinforced-concrete foundation adjacent the blast furnace.

SUMMARY OF THE INVENTION

These objects are attained according to the instant invention in a metallurgical molten-metal runner having a support trough, a trough-shaped temperature-equalizing layer received in and lining the trough, means for cooling the layer isothermally to about 100° C., a permanent refractory outer lining received in and lining the layer, and a renewable refractory inner lining received in and lining the outer lining and in direct contact with molten metal in the runner.

The system of this invention shields the surroundings from the heat of the runner and completely confines and localizes any leakage through the refractory lining. Differential thermal expansion is eliminated at the layer which is isothermal, that is its temperature is overall about the same. Slip joints tailored for the exact movement that will be encountered can easily be provided. In addition materials of different thermal conductivity can be used to limit heat loss from the contained molten metal. In particular it is possible to cool those regions of greatest wear, for instance at the metal/slag interface, to minimize erosion of the lining, while allowing the rest of the melt to stay very hot.

According to this invention the layer is of greater thermal conductivity than the linings. The means includes conduits in heat-conducting engagement with the layer and means for circulating a coolant through the conduits. Water or, for safety's sake, oil can be used as the coolant, normally in liquid state to keep the layer below 100° C.

The layer according to this invention has a coefficient of thermal conductivity greater than 10Kcal/m·°C.·h, preferably above 25Kcal/m·°C.·h. This layer is composed principally of silicon carbide, semigraphite, or graphite. It is also within the scope of this invention for the layer to be principally of a metal, for instance copper, iron, or steel.

The conduits according to this invention are imbedded in the layer. The are positioned at distances from each other and from the linings dependent on the desired temperature profile.

DESCRIPTION OF THE DRAWING

The above and other features and advantages will become more readily apparent from the following, reference being made to the accompanying drawing in which.

SPECIFIC DESCRIPTION

Figure 1:
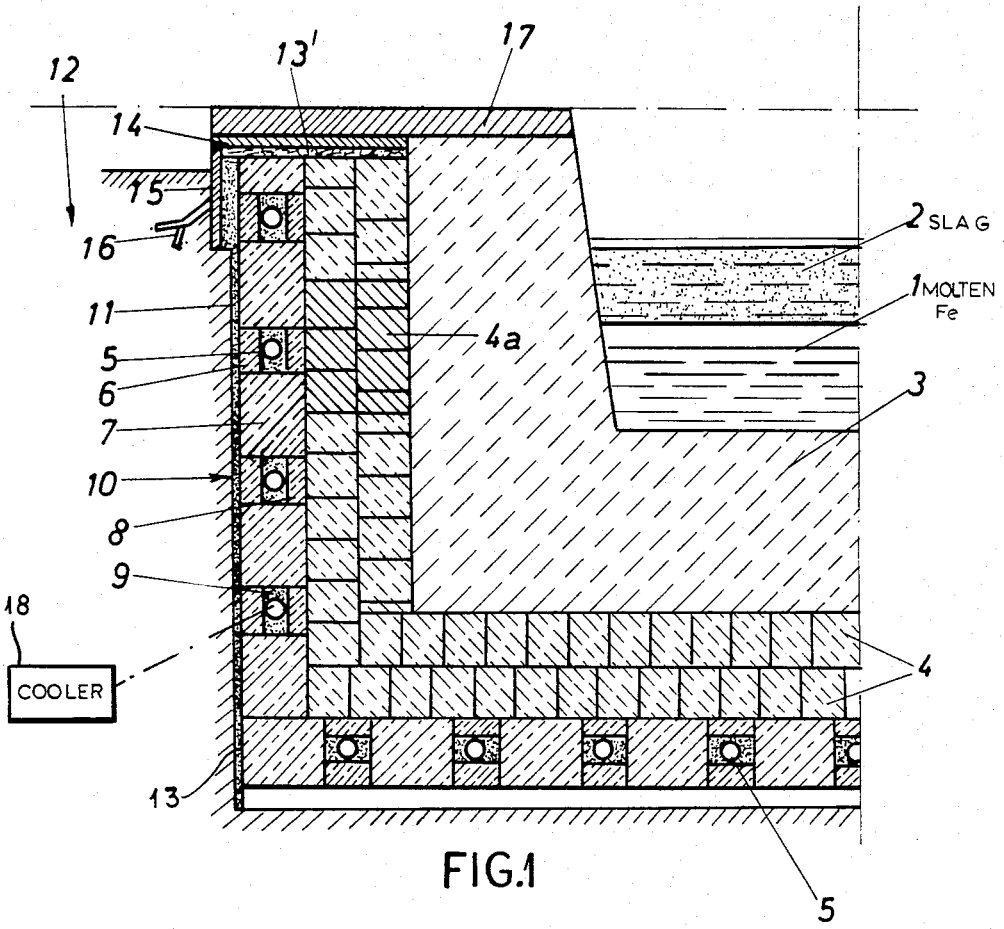
FIG. 1 is a partly diagrammatic and partly cross-sectional view through a runner according to this invention.

As seen in FIG. 1 a body 1 of molten metal covered by a slag layer 2 directly contacts a renewable refractory lining 3 that is carried on a permanenent double-brick outer refractory lining 4. This structure in turn sits on an isothermal layer formed by rows 7 of graphite bricks that flank cooling units 10 constituted as tubes 5 imbedded in conductive masses 9 sandwiched between smaller graphite bricks 8. Both the lining 3 and the masses 9 are formed in situ, whereas the bricks 7 and 8 and the bricks forming the lining 4 are of rigid prefabricated construction.

The above-described structure fits in a trough formed in a reinforced-concrete foundation 12, with interposition of a layer 11 of elastomeric material permitting some relative movement and evening out the irregularities in the concrete foundation 12. A top plate 14 is welded to an upright plate 15 fixed with anchors 16 in the foundation 12 and sits via a slip layer 13' on top of the uppermost bricks 7 and the upper edge of the lining 4. A heavy-duty layer of concrete 12 lies atop this plate 14 and the upper edges of the U-section inner lining 3 to protect same during any accidental overflowing of the runner.

A cooler 18 passes liquid water, or oil if desired, through the tubes 5 to maintain the layer 5–10 at less than 100° C., normally about 60° C. Some tubes can be hooked up separate for more or less heat exchange depending on local requirements. The outer lining 4 prevents excessive cooling of the molten-iron body 1. Locations of particularly heavy wear can be fitted with bricks 4*a* of semigraphite which is of high thermal conductivity. This lining 4 lies between about 100° C. and 1100° C. The graphite layer 5–10 is, however, so cold that even if the linings 3 and 4 crack any of the molten iron touching it will solidify. The graphite, having a coefficient of thermal conductivity equal to about 80Kcal/m·°C.·h, could be replaced by silicon carbide (15Kcal/m·°C.·h) or by semigraphite (30Kcal/m·°C.·h). The mass 9 in which the tubes 5 are imbedded can have a very low coefficient, for example 2Kcal/m·°C.·h, so long as sufficient liquid is passed through the tubes to keep the layer temperature below 100° C.

Figure 2:
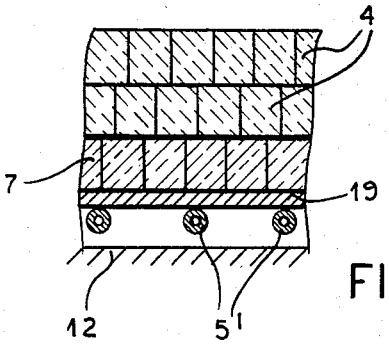
FIG. 2 is a sectional view of a detail of another runner according to the invention.

As shown in FIG. 2, it is also possible to form the isothermal layer at least partially of metal, for instance cast iron with a coefficient of about 80Kcal/m·°C.·h, steel (30Kcal/m·°C.·h), or even copper (300Kcal/m·°C.·h) could be employed, using plates sufficiently thick—normally 5 cm to 20 cm—that they can carry off sufficient heat. Thus tubes 5' are soldered to metallic plates 19 in turn bonded to the layer of graphite bricks 7. The spacing of the tubes 5' is varied in this arrangement, being close in regions needing considerable cooling and far in regions needing less cooling.

With this system it is possible to imbed the entire runner directly in the concrete foundation 12, considerably reducing construction costs. The system could be suspended above the floor level, with U-shaped beams holdng it together and supporting the coolant tubes 5. The outside of such a structure would be relatively cool and no particular danger to equipment operators.

The heat carried off in the water flowing through the tubes 5 can be used elsewhere, for instance in the preheater. Nonetheless using a standard refractory lining it remains possible to keep the metal molten for 5h to 8h between subsequent tappings of the blast furnace.

I claim:

1. A runner for conducting molten metal from a furnace, the runner comprising:

a support trough;

a trough-shaped temperature-equalizing layer received in and lining the trough;

means for circulating a liquid coolant through the equalizing layer for cooling the layer to a uniform temperature of about 100° C.;

a permanent refractory outer lining of bricks received in and lining the layer; and a renewable packed refractory inner lining received in and lining the outer lining for directly contacting molten metal when the latter is in the runner, the temperature-equalizing layer being more thermally conductive than the linings, said means for cooling the layer including conduits in heat-conducting engagement with the layer and means for circulating a coolant through the conduits, said layer having a coefficient of thermal conductivity greater than 10Kcal/m·°C.·h and being composed of at least one material selected from the group which consists of silicon carbide, semigraphite or graphite.

2. The molten-metal runner defined in claim 1 wherein the layer has a coefficient of thermal conductivity greater than 25Kcal/m·°C.·h.

3. The molten-metal runner defined in claim 1 wherein the layer is composed principally of graphite.

4. The molten-metal runner defined in claim 1 wherein the conduits are imbedded in the layer.

5. The molten-metal runner defined in claim 4 wherein the conduits are imbedded in the layer at distances from each other and from the linings dependent on the desired temperature profile.

6. The molten-metal runner defined in claim 1 wherein the support trough is of concrete.

7. The molten-metal runner defined in claim 1 wherein some parts of the permanent refractory outer lining are substantially more thermally conductive than the remainder of the outer lining.

* * * * *